US006768474B2

(12) United States Patent
Hunt

(10) Patent No.: US 6,768,474 B2
(45) Date of Patent: Jul. 27, 2004

(54) ANTENNA MOUNTING ASSEMBLY AND METHOD

(75) Inventor: Robert E. Hunt, Evansville, IN (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/324,013

(22) Filed: Dec. 20, 2002

(65) Prior Publication Data

US 2004/0119655 A1 Jun. 24, 2004

(51) Int. Cl.[7] ..... H01Q 1/12

(52) U.S. Cl. ..... 343/892; 343/890; 248/218.4; 248/230.4; 248/512

(58) Field of Search ..... 343/878, 882, 343/890, 891, 892, 879, 880; 248/218.4, 228.4, 229.23, 230.4, 512, 514, 539

(56) References Cited

U.S. PATENT DOCUMENTS

| | | | | | |
|---|---|---|---|---|---|
| 4,126,864 | A | * | 11/1978 | Hopkins | 343/704 |
| 4,500,064 | A | * | 2/1985 | Calabro | 248/539 |
| 5,787,673 | A | | 8/1998 | Noble | 52/726.1 |
| 5,920,291 | A | * | 7/1999 | Bosley | 343/892 |
| 5,926,151 | A | * | 7/1999 | Hagiwara et al. | 343/882 |
| 5,971,345 | A | * | 10/1999 | Khalaf | 248/512 |
| 6,175,339 | B1 | * | 1/2001 | Macon | 343/892 |
| 6,232,928 | B1 | * | 5/2001 | Zimmerman et al. | 343/882 |
| 6,267,339 | B1 | * | 7/2001 | Gates et al. | 248/218.4 |
| 6,283,425 | B1 | * | 9/2001 | Liljevik | 248/230.4 |

* cited by examiner

*Primary Examiner*—Tho Phan
(74) *Attorney, Agent, or Firm*—Baker & Hostetler LLP

(57) ABSTRACT

An antenna attachment device and method that can attach to a vertical or angled structural member such as, for example, a vertical or an angled antenna tower leg, and that can support a mounting pipe at a desired angle such as, for example, in a vertical position.

17 Claims, 2 Drawing Sheets

ANTENNA MOUNTING ASSEMBLY AND METHOD

FIELD OF THE INVENTION

The invention pertains to mounting devices and methods. More particularly, the invention pertains to the field of assemblies and methods for attaching a component such as, for example, an antenna device, to a supporting structure such as, for example, an antenna tower.

BACKGROUND OF THE INVENTION

A wide range of types of antennas including, for example, mast antennas, dish antennas, horn antennas and other types of antennas and related components are often supported by an antenna tower or other structure to provide elevation to the antenna.

It is generally desirable that a mounting device be provided for conveniently mounting the antenna to the tower. Since the spatial orientation of the antenna is often critical, it is desirable that the mounting apparatus be configured to permit proper spatial orientation of the antenna.

It is also common for antenna towers to be tapered. That is, often an antenna tower has longitudinal frame members, referred to as tower legs, extending along its length from a wide tower base to a narrow section or point at or near the top of the tower. The tower legs are often canted at an angle anywhere from substantially vertical to five or more degrees off of vertical. Often, the antenna element is intended to be mounted via a mounting pipe which should be vertical to support the antenna element in the vertical directions. The angle of the tower leg presents a problem in that it is generally desirable to have a simple bracket device that would attach to the mounting pipe and hold the antenna element in a vertical direction.

Accordingly, it would be desirable to have a bracket that can attach in one place to a tower leg, and can attach in another place to a pipe mount of an antenna or other component to hold the pipe mount in a vertical orientation.

Further, since the tower leg or some other structural component on the tower may in some situations be completely vertical, and in other situations may be at an angle, it would be desirable to have a bracket that is easily adaptable between a vertical tower leg, and a tower leg having any of a variety of angles, for example, between zero and five degrees from vertical.

In the prior art, it has often been necessary to manufacture custom attachment devices that are usable only with a specific angle of tower leg. Custom attachment devices are generally difficult to retrofit for use in a different angle. Moreover, having a number of custom devices for each possible angle can require an increase in stocking effort for a manufacturer and/or installer.

Accordingly, there is a need in the art for an antenna aattachment device and method that can attach to a vertical or angled structural member such as, for example, a vertical or an angled antenna tower leg, and that can support a mounting pipe at a desired angle such as, for example, in a vertical position.

SUMMARY OF THE INVENTION

The foregoing needs are met, at least to a great extent, by the present invention, which at least in some embodiments provides an antenna attachment device and method that can attach to an angled structural member such as, for example, a vertical or an angled antenna tower leg, and that can support a mounting pipe at a desired angle such as for example in a vertical position.

In one aspect the invention provides an apparatus for mounting an item to a structural member, the apparatus comprising: a first clamping assembly that clamps onto the item and clamps onto the structural member and connects them at a first distance from each other; and a second clamping assembly that clamps to the item and clamps onto the structural member and connects them at a second distance from each other, said second clamping assembly having at least one spacer removable to vary the second distance between the item and the structural member.

In another aspect the invention provides a clamp assembly for clamping an item to a structural member, the assembly comprising: a back plate; at least two threaded rods attached to the back plate; a mounting clamp attached to the threaded rods and having a cylindrical pipe portion; at least one fist U-bolt configured to partially surround the cylindrical pipe portion of the clamp and rotatable around the cylindrical pipe portion; an attachment plate attached to the U-bolt; and at least one second U-bolt for attaching to the item in conjunction with the attachment plate.

In another aspect the invention provides an apparatus for mounting an item to a structural member, the apparatus comprising: first means for clamping onto the item and clamping onto the structural member and connecting them at a first distance from each other; and second means for clamping onto the item and clamping onto the structural member and connecting them at a second distance from each other, said second clamping means having at least one spacer removable to vary the second distance between the item and the structural member.

In another aspect the invention provides a clamp assembly for clamping an item to a structural member, the assembly comprising: first means for clamping onto the item and clamping onto the structural member and connecting them at a first distance from each other, and second means for clamping onto the item and clamping onto the structural member and connecting them at a second distance from each other, means permitting rotation between the first and second means; and removable spacing means.

In another aspect the invention provides a method for mounting an item to a structural member, the method comprising: clamping a first clamping assembly onto the item and onto the structural member and connecting them at a first distance from each other; and clamping a second clamping assembly onto the item and onto the structural member and connecting them at a second distance from each other, and inserting a removable spacer to vary the second distance between the item and the structured member.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
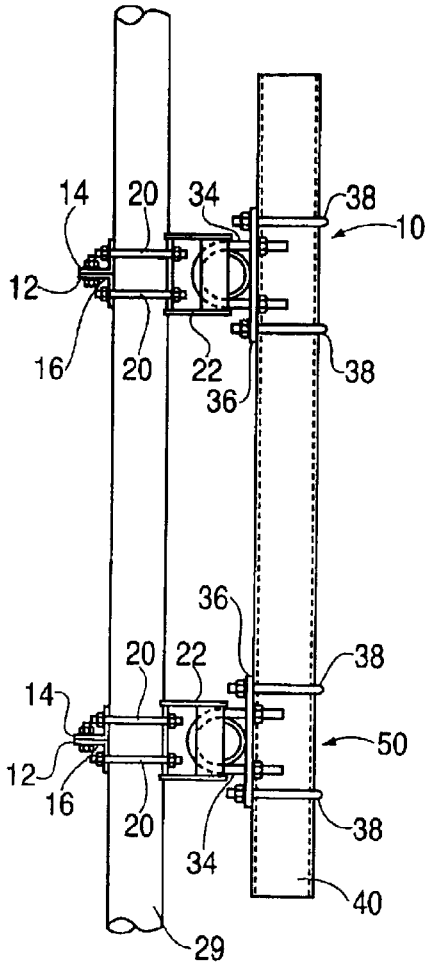
FIG. 1 is a side view illustrating a preferred embodiment of the present invention attaching a mounting pipe to a tower leg, including an upper clamp assembly and a lower clamp assembly.
Figure 2:
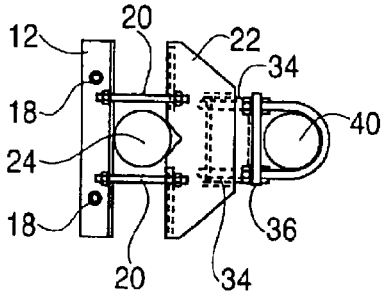
FIG. 2 is a top view of the upper clamp assembly shown in FIG. 1.

Preferred embodiments of the present invention will now be described with reference to the drawings, in which like reference numerals identify like parts throughout. Referring now particularly to FIGS. 1 and 2, the apparatus includes a upper clamping assembly 10 and similar lower clamping assembly 50 as shown.

Each clamping assembly 10 and 50 includes a backing angle assembly 12 which consists of two pieces of angle iron 14 and 16 connected together by two bolts 18. The backing angle assembly 12 is connected by four longitudinal threaded rods 20 that connect to a pipe mounting clamp element 22.

Figure 5:
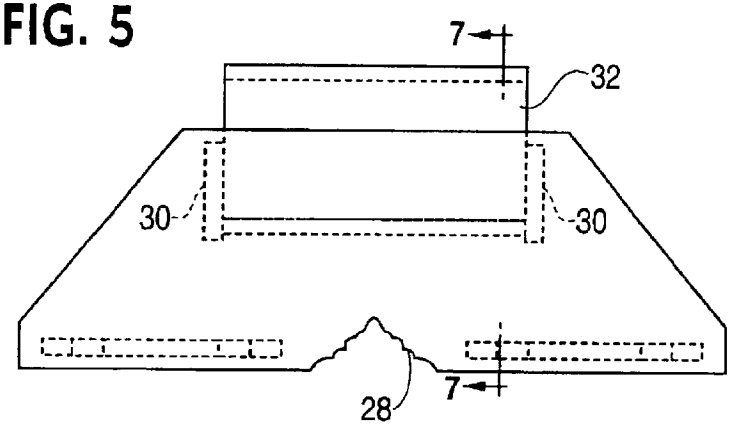
FIG. 5 is a top view of a mounting clamp element.
Figure 6:
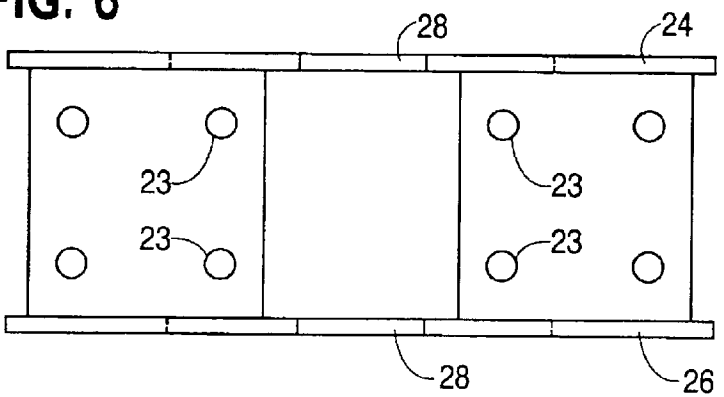
FIG. 6 is a front view of the mounting clamp element of FIG. 5.
Figure 7:
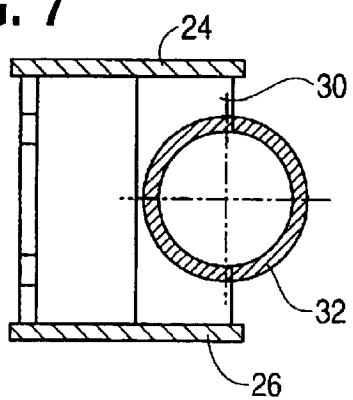
FIG. 7 is a cross-sectional view taken through line 7—7 in FIG. 5.

As also seen in FIGS. 5–7, the pipe mounting clamp element 22 has holes 23 to receive the rods 20 and has an upper plate 24 and a lower plate 26. Each of the upper and lower plates 24 and 26 have a notch 28 to help securely hold the tower leg 29 or other support to which the clamp assembly 10 is mounted. Additional holes 27 may be provided to accommodate different sizes of tower legs 29.

Returning to FIGS. 1 and 2, and FIGS. 5–7, this arrangement including the backing angle assembly 12 and the mounting clamp element 22, grip the tower leg 29 securely. The mounting clamp 22 further has two side plates 30 surrounding a partially internal pipe section 32. The pipe section 32 can be surrounded by a pair of U-clamps 34 which are bolted to a pipe attachment plate 36.

The pipe attachment plate 36 also supports a pair of U-bolts 38 which are attached to the pipe attachment plate 36 and surround the pipe mount 40 as shown to hold the pipe mount 40. Since the pipe mount 40 is either part of the antenna or other component being mounted, (or is at least attached to the antenna or other component being mounted), the combination of clamping assemblies 10 and 50 provide a secure mounting of the antenna or other component to the tower leg.

The upper clamping assembly 50 is substantially the same as the lower clamping assembly 10. As seen in FIG. 1, where it is desirable for the pipe mount 40 to be parallel to the tower leg 29 or other structural member, for example for a vertical tower leg 29, the configuration of FIG. 1 will provide such an arrangement.

Figure 3:
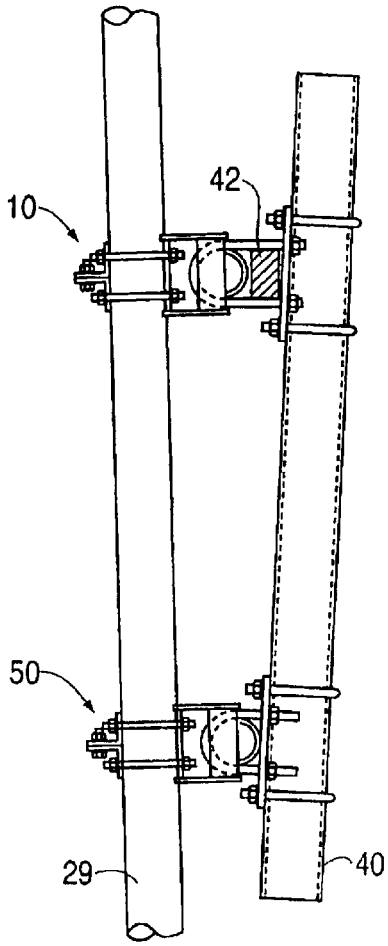
FIG. 3 is a side view of an embodiment according to a preferred embodiment of the invention utilizing a spacer on the upper clamping assembly to accommodate an angled tower leg.
Figure 4:
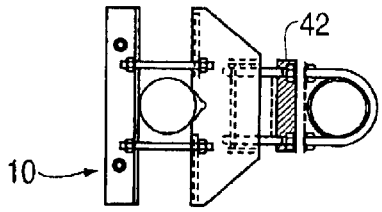
FIG. 4 is a top view of the upper clamp assembly shown in FIG. 3.

Turning now to FIGS. 3 and 4, in situations where, for example, an angled tower leg 29 is present, such as for a tapered tower, it is often desired to have an angle between the pipe mount 40 and the tower leg 29. In such cases, a spacer 42 can be installed in the upper mounting assembly 50 as shown in FIGS. 3 and 4. In particular, the spacer 42 is preferably installed between the pipe mounting clamp element 22 and the pipe attachment plate 32. The spacer 42 is drilled with holes for U-bolts 34, or shaped to fit inside the U-bolts 34. Further, the U-bolts 34 have sufficient length to accept the spacer 42 and still bolt around the pipe section 32 and through the spacer 42 and pipe attachment plate 32.

The arrangement described here including the spacer 42 is particularly suitable for accommodating angled tower legs. With respect to the lower clamping assembly 10, it will be appreciated that the U-bolts 34 are able to rotate with a rotational degree of freedom about the pipe section 32 of the pipe mounting clamp element 22 in the condition shown in FIG. 3. By virtue of this degree of freedom, when a spacer 42 is added in the upper clamping assembly 50, no additional stress forces are imparted that would tend to bend or otherwise damage or distress the lower clamping assembly 10, or its connection to the tower leg 29 and the pipe mount 40.

The upper clamping assembly 50 similarly has a degree of freedom in the interaction between the U-bolts 34 and the pipe section 32 of the pipe mounting clamp element 22, so that an angular difference between the tower leg 29 and the pipe mount 40 can also be accommodated without bending or torsional stresses in the upper clamping assembly.

It will be appreciated that the preferred embodiment described herein provides for an easily manufactured, easily assembled, and easily installed system. For example, the system only requires wrenches to tighten bolts to install. The system does not require drilling or otherwise modifying the tower leg. Moreover, the system provides degrees of freedom as described above to accommodate an angle between the tower leg and the mounting pipe. Also, once installed, the system is able to securely resist forces in all directions.

A further benefit of the preferred embodiment is that different angles can be accommodated merely by selecting appropriate size spacers. Thus, in order to accommodate specific angles, it is only necessary that appropriate spacers be available, and all the other components of the system can remain the same.

The size of the backing angle, the pipe mounting clamp, the various U-bolts, and the threaded rods can be selected based on the diameters of the tower leg and the mounting pipes, as well as the weight of the antenna, wind forces or related factors. A range of different spacer sizers can be used. In addition, two or more of spacers of similar or different sizes can be "stacked" to achieve the desired spacing.

The vertical distance between the upper clamping assembly and the lower clamping assembly is selected based on the overall size of the tower leg and the mounting leg and the forces expected thereon, and further the vertical distance can be selected to adjust the angle of the assembly as described in more detail below.

It will be appreciated that for a given spacer size, simply varying the vertical distance between the upper clamping assembly 10 and the lower clamping assembly 50 will provide a corresponding variation in the angle provided between the tower leg 29 and the mounting pipe 40. This provides another significant benefit of the invention because a single spacer size can provide a range of angular accommodations. Thus, it is only necessary to keep on hand in some embodiments a relatively small number of spacers sizes (or even one type of spacer if they are to be stacked) to provide a relatively wide continuous range of possible angular accommodations.

It will be appreciated that this arrangement provides a highly desirable degree of flexibility in accommodating angles between mounting pipes and tower legs, economical use of relatively standardized stocked parts, and is convenient, economical and light weight. With the exception of the pipe mounting clamp element 22, the other parts used such as the threaded rods, U-bolts and angled brackets can be generally commercially available components.

While the preferred embodiment has been described in the context of mounting an antenna pipe mount 40 to a tower leg 29, it will be appreciated that the present apparatus and method is suitable for a wider range of mounting duties. For example, it may be mounted to other structures besides antenna towers, including for example trusses, bridges, beams, scaffolds, or other support structures.

Further, although the exemplary tower leg 29 shown is a round cylinder, the arrangement shown could also attach to square cross sections or L-shaped, I-shaped, or H-shaped, or other cross sections. Still further, although the pipe mount 40 is shown as being a round cylindrical tube gripped by U-bolts 38, other types of antenna or component mounts may be hold by the invention. For example, it may be desirable to use an angle iron assembly and threaded rod in place of the U-bolts 38 to hold other mounts having other cross-sections.

Also, although the preferred embodiment is described in the context of supporting an antenna such as a mast antenna or a dish, various embodiments of the invention may be used to support any other antenna or device, particularly where it is desired to provide an accommodation between the vertical orientation of the device as compared to the leg or structure to which it is being mounted, but also for parallel mounting.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An apparatus for mounting an item to a structural member, the apparatus comprising:

a first clamping assembly that claims onto the item and clamps onto the structural member and connects them at a first distance from each other; and a second clamping assembly that clamps to the item and clamps onto the structural member and connects them at a second distance from each other, said second clamping assembly having at least one spacer removable to vary the second distance between the item and the structural member, wherein at least one of the first and second clamp assemblies comprises:

a mounting clamp element having a cylindrical pipe section therein; and at least one U-bolt surrounding the pipe section and rotatable about the pipe section.

2. The apparatus according to claim 1, wherein the item is a pipe mount of an antenna.

3. The apparatus according to claim 1, wherein the structural member is a leg of a tower.

4. A clamp assembly for clamping an item to a structural member, the assembly comprising:

a back plate;

at least two threaded rods attached to the back plate;

a mounting clamp attached to the threaded rods and having a cylindrical pipe portion;

at least one first U-bolt configured to partially surround the cylindrical pipe portion of the clamp and rotatable around the cylindrical pipe portion;

an attachment plate attached to the U-bolt; and at least one second U-bolt for attaching to the item in conjunction with the attachment plate.

5. The apparatus according to claim 4, further comprising a removable spacer disposed between the mounting clamp and the attachment plate.

6. The apparatus according to claim 4, wherein the item is a pipe mount of an antenna.

7. The apparatus according to claim 4, wherein the structural member is a leg of a tower.

8. An apparatus for mounting an item to a structural member, the apparatus comprising:

first means for clamping onto the item and clamping onto the structural member and connecting them at a first distance from each other, second means for clamping onto the item and clamping onto the structural member and connecting them at a second distance from each other, said second clamping means having at least one spacer removable to vary the second distance between the item and the structural member, wherein at least one of the first and second clamping means comprises:

a mounting means having a cylindrical pipe section therein; and

U-shaped means for surrounding the pipe section and rotating about the pipe section.

9. The apparatus according to claim 8, wherein the item is a pipe mount of an antenna.

10. The apparatus according to claim 8, wherein the structural member is a leg of a tower.

11. A clamp assembly for clamping an item to a structural member, the assembly comprising:

first means for clamping onto the item and clamping onto the structural member and connecting them at a first distance from each other;

second means for clamping onto the item and clamping onto the structural member and connecting them at a second distance from each other, wherein at least one of the first and second clamping means comprises:

U-shaped means permitting rotation between the first and second means; and removable spacing means.

12. The apparatus according to claim 11, wherein the item is a pipe mount of an antenna.

13. The apparatus according to claim 11, wherein the structural member is a leg of a tower.

14. A method for mounting an item to a structural member, the method comprising:

clamping a first clamping assembly onto the item and onto the structural member and connecting them at a first distance from each other;

clamping a second clamping assembly onto the item and onto the structural member and connecting them at a second distance from each other; wherein at least one of the first and second clamping assemblies comprises:

a mounting clamp having a cylindrical pipe section therein; and at least one U-bolt surrounding the pipe section and rotatable about the pipe section; and inserting a removable spacer to vary the second distance between the item and the structured member.

15. The method according to claim 14, wherein the item is a pipe mount of an antenna.

16. The method according to claim 14, wherein the structural member is a leg of a tower.

17. The method according to claim 14, further comprising inserting a plurality of stacked spacers.

* * * * *

UNITED STATES PATENT AND TRADEMARK OFFICE

CERTIFICATE OF CORRECTION

PATENT NO. : 6,768,474 B2
DATED : July 27, 2004
INVENTOR(S) : Robert E. Hunt

It is certified that error appears in the above-identified patent and that said Letters Patent is hereby corrected as shown below:

Column 5,
Line 40, replace “claims” with -- clamps --.

Signed and Sealed this

Sixteenth Day of November, 2004

JON W. DUDAS
*Director of the United States Patent and Trademark Office*